US009252481B2

(12) United States Patent
Malek et al.

(10) Patent No.: US 9,252,481 B2
(45) Date of Patent: Feb. 2, 2016

(54) ADJUSTABLE ANTENNA STRUCTURES FOR ADJUSTING ANTENNA PERFORMANCE IN ELECTRONIC DEVICES

(71) Applicant: Apple Inc., Cupertino, CA (US)

(72) Inventors: Shayan Malek, San Jose, CA (US); John B. Ardisana, II, San Francisco, CA (US); Michael B. Wittenberg, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 369 days.

(21) Appl. No.: 13/706,758

(22) Filed: Dec. 6, 2012

(65) Prior Publication Data

US 2014/0159989 A1 Jun. 12, 2014

(51) Int. Cl.

| | |
|---|---|
| ***H01Q 1/24*** | (2006.01) |
| ***H01Q 7/00*** | (2006.01) |
| ***H01Q 9/04*** | (2006.01) |
| ***H01Q 13/10*** | (2006.01) |

(52) U.S. Cl.

CPC ..... *H01Q 1/243* (2013.01); *H01Q 7/00* (2013.01); *H01Q 9/0421* (2013.01); *H01Q 9/0442* (2013.01); *H01Q 13/10* (2013.01); *Y10T 29/49018* (2015.01)

(58) Field of Classification Search

CPC ..... H01Q 1/243; H01Q 9/42; H01Q 9/14

See application file for complete search history.

(56) References Cited

U.S. PATENT DOCUMENTS

| | | | | |
|---|---|---|---|---|
| 6,980,160 | B2 | 12/2005 | Candal | |
| 8,319,695 | B2 | 11/2012 | Rofougaran | |
| 2002/0000941 | A1 * | 1/2002 | Johnson | 343/702 |
| 2002/0105474 | A1 * | 8/2002 | Kitamura et al. | 343/850 |
| 2008/0055164 | A1 * | 3/2008 | Zhang et al. | 343/702 |
| 2010/0123632 | A1 * | 5/2010 | Hill et al. | 343/702 |
| 2011/0316751 | A1 | 12/2011 | Jarvis et al. | |
| 2012/0019420 | A1 | 1/2012 | Caimi et al. | |
| 2012/0178382 | A1 | 7/2012 | Merz et al. | |
| 2012/0198689 | A1 | 8/2012 | Schlub et al. | |

* cited by examiner

*Primary Examiner* — Hoanganh Le

(74) *Attorney, Agent, or Firm* — Treyz Law Group, P.C.; G. Victor Treyz; Zachary D. Hadd

(57) ABSTRACT

Adjustable antenna structures may be used to compensate for manufacturing variations in electronic device antennas. An electronic device antenna may have an antenna feed and conductive structures such as portions of a peripheral conductive electronic device housing member and other conductive antenna structures. The adjustable antenna structures may have a movable dielectric support. Multiple conductive paths may be formed on the dielectric support. The movable dielectric support may be installed within an electronic device housing so that a selected one of the multiple conductive paths is coupled into use to convey antenna signals. Coupling the selected path into use adjusts the position of an antenna feed terminal for the antenna feed and compensates for manufacturing variations in the conductive antenna structures that could potentially lead to undesired variations in antenna performance.

23 Claims, 18 Drawing Sheets

ADJUSTABLE ANTENNA STRUCTURES FOR ADJUSTING ANTENNA PERFORMANCE IN ELECTRONIC DEVICES

BACKGROUND

This relates generally to electronic devices, and more particularly, to electronic devices that have antennas.

Electronic devices such as computers and handheld electronic devices are often provided with wireless communications capabilities. For example, electronic devices may use long-range wireless communications circuitry such as cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

Antenna performance can be critical to proper device operation. Antennas that are inefficient or that are not tuned properly may result in dropped calls, low data rates, and other performance issues. There are limits, however, to how accurately conventional antenna structures can be manufactured.

Many manufacturing variations are difficult or impossible to avoid. For example, variations may arise in the size and shape of printed circuit board traces, variations may arise in the density and dielectric constant associated with printed circuit board substrates and plastic parts, and conductive structures such as metal housing parts and other metal pieces may be difficult or impossible to construct with completely repeatable dimensions. Some parts are too expensive to manufacture with precise tolerances and other parts may need to be obtained from multiple vendors, each of which may use a different manufacturing process to produce its parts.

Manufacturing variations such as these may result in undesirable variations in antenna performance. An antenna may, for example, exhibit an antenna resonance peak at a first frequency when assembled from a first set of parts, while exhibiting an antenna resonance peak at a second frequency when assembled from a second set of parts. If the resonance frequency of an antenna is significantly different than the desired resonance frequency for the antenna, a device may not function properly.

It would therefore be desirable to provide a way in which to address issues such as these so as to improve antenna manufacturability and performance.

SUMMARY

Adjustable antenna structures may be used to compensate for manufacturing variations in electronic device antennas. An electronic device antenna may be formed from conductive antenna structures such as conductive electronic device housing structures. Conductive electronic device housing structures may include a peripheral conductive housing member that runs around a peripheral portion of an electronic device. A spring may be welded to an inner surface of the peripheral conductive housing member.

The adjustable antenna structures may include a dielectric member on which metal traces or other conductive paths are formed. The metal traces may contact the spring. The position of the dielectric member may be adjusted relative to the device so that a selected one of the multiple conductive paths is switched into use to convey antenna signals between an antenna signal trace such as a transmission line conductor and the conductive antenna structures such as the peripheral conductive housing member.

Further features, their nature and various advantages will be more apparent from the accompanying drawings and the following detailed description of the preferred embodiments.

DETAILED DESCRIPTION

Figure 1:
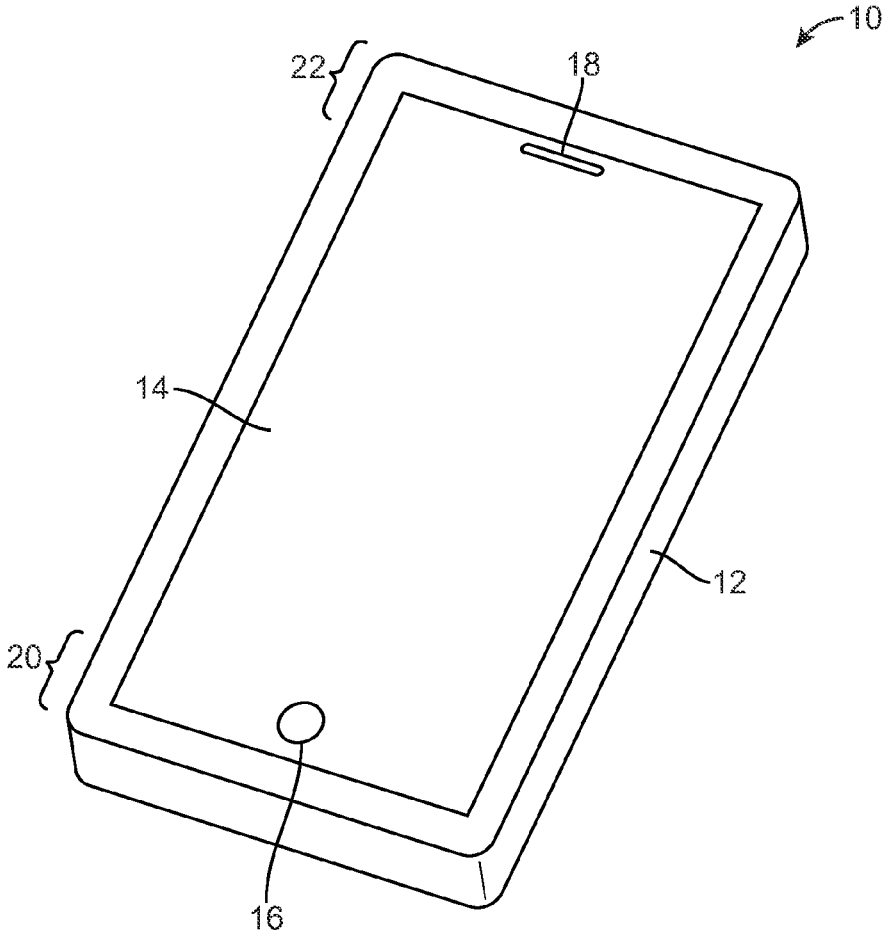
FIG. 1 is a perspective view of an illustrative electronic device with wireless communications circuitry in accordance with an embodiment.

An illustrative electronic device of the type that may be provided with adjustable antenna structures to compensate for manufacturing variations is shown in FIG. 1. Electronic devices such as illustrative electronic device 10 of FIG. 1 may be laptop computers, tablet computers, cellular telephones, media players, other handheld and portable electronic devices, smaller devices such as wrist-watch devices, pendant devices, headphone and earpiece devices, other wearable and miniature devices, or other electronic equipment.

As shown in FIG. 1, device 10 includes housing 12. Housing 12, which is sometimes referred to as a case, may be formed of materials such as plastic, glass, ceramics, carbon-fiber composites and other composites, metal, other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, liquid crystal display (LCD) components, or other suitable image pixel structures. A cover layer such as a cover glass member may cover the surface of display 14. Buttons such as button 16 may pass through openings in the cover glass. Openings may also be formed in the cover glass of display 14 to form a speaker port such as speaker port 18. Openings in housing 12 may be used to form input-output ports, microphone ports, speaker ports, button openings, etc.

Wireless communications circuitry in device 10 may be used to form remote and local wireless links. One or more antennas may be used during wireless communications. Single band and multiband antennas may be used. For example, a single band antenna may be used to handle local area network communications at 2.4 GHz (as an example). As another example, a multiband antenna may be used to handle cellular telephone communications in multiple cellular telephone bands. Antennas may also be used to receive global positioning system (GPS) signals at 1575 MHz in addition to cellular telephone signals and/or local area network signals. Other types of communications links may also be supported using single-band and multiband antennas.

Antennas may be located at any suitable locations in device 10. For example, one antenna may be located in an upper region such as region 22 and another antenna may be located in a lower region such as region 20. If desired, antennas may be located along device edges, in the center of a rear planar housing portion, in device corners, etc.

Antennas in device 10 may be used to support any communications bands of interest. For example, device 10 may include antenna structures for supporting local area network communications (e.g., IEEE 802.11 communications at 2.4 GHz and 5 GHz for wireless local area networks), signals at 2.4 GHz such as Bluetooth® signals, voice and data cellular telephone communications (e.g., cellular signals in bands at frequencies such as 850 MHz, 900 MHz, 1800 MHz, 1900 MHz, 2100 MHz, etc.), global positioning system (GPS) communications at 1575 MHz, signals at 60 GHz (e.g., for short-range links), etc.

Figure 2:
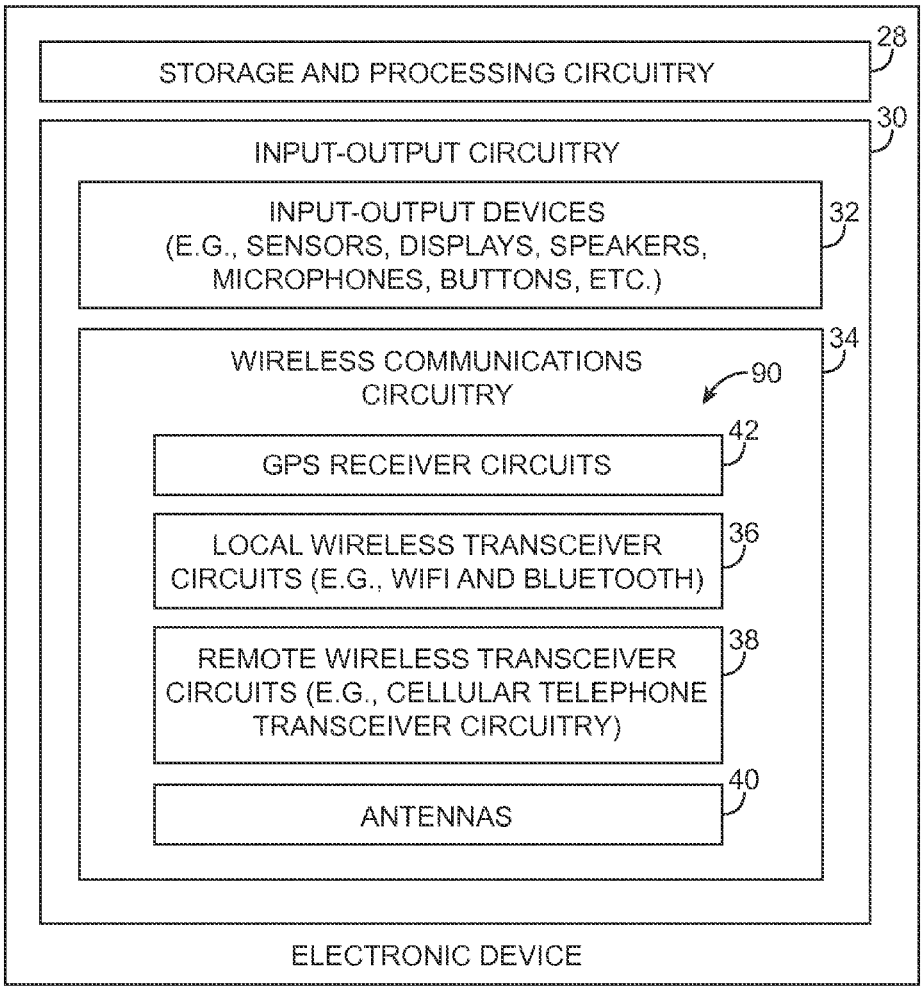
FIG. 2 is a schematic diagram of an illustrative electronic device with wireless communications circuitry in accordance with an embodiment.

A schematic diagram showing illustrative components that may be used in device 10 of FIG. 1 is shown in FIG. 2. As shown in FIG. 2, device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands at 850 MHz, 900 MHz, 1800 MHz, 1900 MHz, and 2100 MHz, or other bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
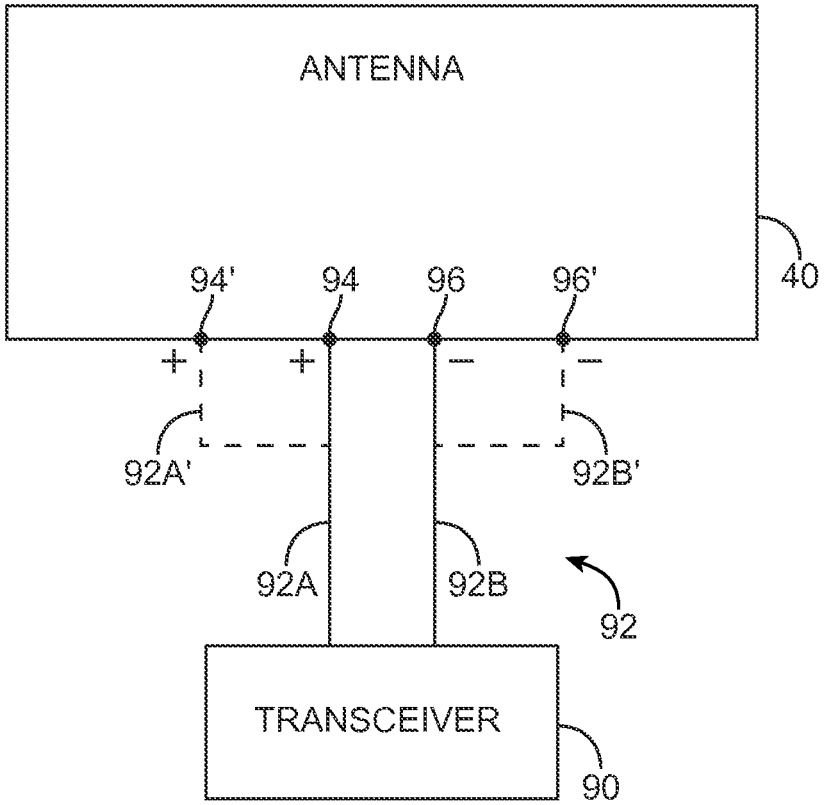
FIG. 3 is circuit diagram of illustrative wireless communications circuitry having a radio-frequency transceiver coupled to an antenna by a transmission line in accordance with an embodiment.

As shown in FIG. 3, transceiver circuitry 90 may be coupled to one or more antennas such as antenna 40 using transmission line structures such as transmission line 92. Transmission line 92 may have positive signal path 92A and ground signal path 92B. Paths 92A and 92B may be formed from metal traces on rigid and flexible printed circuit boards, may be formed on dielectric support structures such as plastic, glass, and ceramic members, may be formed as part of a cable, etc. Transmission line 92 may be formed using one or more microstrip transmission lines, stripline transmission lines, edge coupled microstrip transmission lines, edge coupled stripline transmission lines, coaxial cables, or other suitable transmission line structures.

Transmission line 92 may be coupled to an antenna feed formed from antenna feed terminals such as positive antenna feed terminal 94 and ground antenna feed terminal 96. As shown in FIG. 3, changes may be made to transmission line conductors 92A and 92B (e.g., to change path 92A so that it uses path 92A' to couple to positive antenna feed terminal 94' rather than positive antenna feed terminal 94 and to change path 92B so that it follows path 92B' to couple to ground antenna feed terminal 96' rather than ground antenna feed terminal 96). Changes to the structure of the antenna feed for antenna 40 (e.g., the positions of the positive and/or ground antenna feed terminals among the structures of the antenna) affect antenna performance. In particular, the frequency response of the antenna (characterized, as an example, by a standing wave ratio plot as a function of operating frequency) will exhibit changes at various operating frequencies. In some situations, the antenna will become more responsive at a given frequency and less responsive at another frequency. Feed alterations may also create global antenna efficiency increases or global antenna efficiency decreases.

Figure 4:
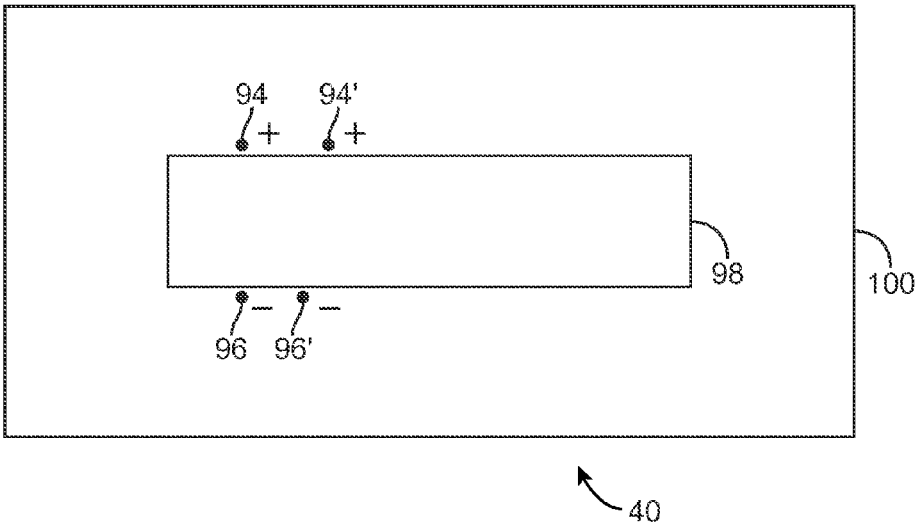
FIG. 4 is a top view of a slot antenna showing how the position of antenna feed terminals may be varied to adjust antenna performance and thereby compensate for manufacturing variations in accordance with an embodiment.

A diagram showing illustrative feed positions that may be used in a slot antenna in device 10 is shown in FIG. 4. As shown in FIG. 4, slot antenna 40 may be formed from conductive structures 100 that form slot 98. Slot 98 may be formed from a closed or open rectangular opening in structures 100 or may have other opening shapes. Slot 98 is generally devoid of conductive materials. In a typical arrangement, some or all of slot 98 may be filled with air and some or all of slot 98 may be filled with other dielectric materials (e.g., electronic components that are mostly formed from plastic, plastic support structures, printed circuit board substrates such as fiberglass-filled epoxy substrates, flex circuits formed from sheets of polymer such as polyimide, etc.).

In antennas such as slot antenna 40 of FIG. 4, the position of the antenna feed tends to affect antenna performance. For example, antenna 40 of FIG. 4 will typically exhibit a different frequency response when fed using an antenna feed formed from positive antenna feed terminal 94 and ground antenna feed terminal 96 than when fed using positive antenna feed terminal 94' and ground antenna feed terminal 96'.

Figure 5:
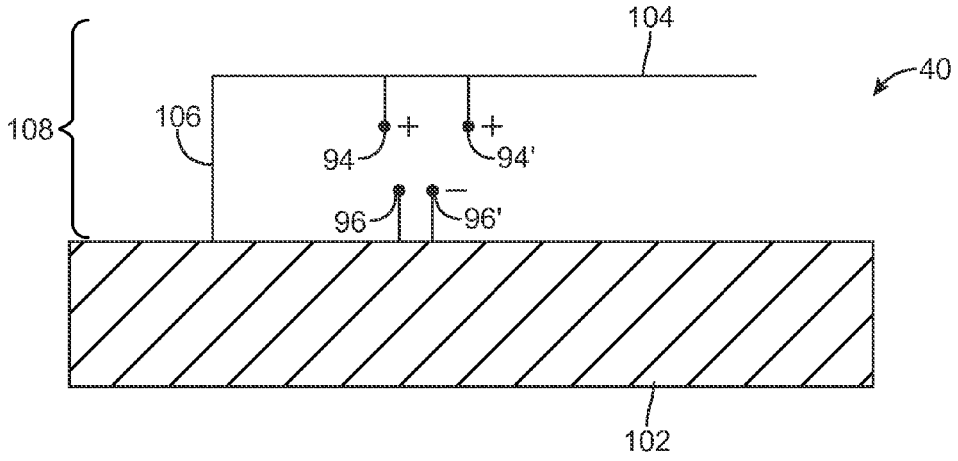
FIG. 5 is a diagram of an inverted-F antenna showing how the position of antenna feed terminals may be varied to adjust antenna performance and thereby compensate for manufacturing variations in accordance with an embodiment.

FIG. 5 is a diagram showing illustrative feed positions that may be used in an inverted-F antenna in device 10. As shown in FIG. 5, inverted-F antenna 40 may be formed from antenna ground 102 and antenna resonating element 108. Antenna ground 102 and antenna resonating element 108 may be formed from one or more conductive structures in device 10 (e.g., conductive housing structures, printed circuit board traces, wires, strips of metal, etc.). Antenna resonating element 108 may have a main arm such as antenna resonating element arm 104. Short circuit branch 106 may be used to create a short circuit path between arm 104 and ground 102.

The position of the antenna feed within antenna 40 of FIG. 5 will generally affect antenna performance. In particular, movements of the antenna feed to different positions along arm 104 will result in different antenna impedances and therefore different frequency responses for the antenna. For example, antenna 40 will typically exhibit a different frequency response when fed using antenna feed terminals 94 and 96 rather than antenna feed terminals 94' and 96'.

The configuration of the conductive structures in antenna 40 such as antenna resonating element structures (e.g., the structures of antenna resonating element 108 of FIG. 5) and antenna ground structures (e.g., antenna ground conductor structures 102 of FIG. 5) also affects antenna performance. For example, changes to the length of antenna resonating element arm 104 of FIG. 5, changes to the position of short circuit branch 106 of FIG. 5, changes to the size and shape of ground 102 of FIG. 5, and changes to the slot antenna structures of FIG. 4 will affect the frequency response of the antenna.

Figure 6:
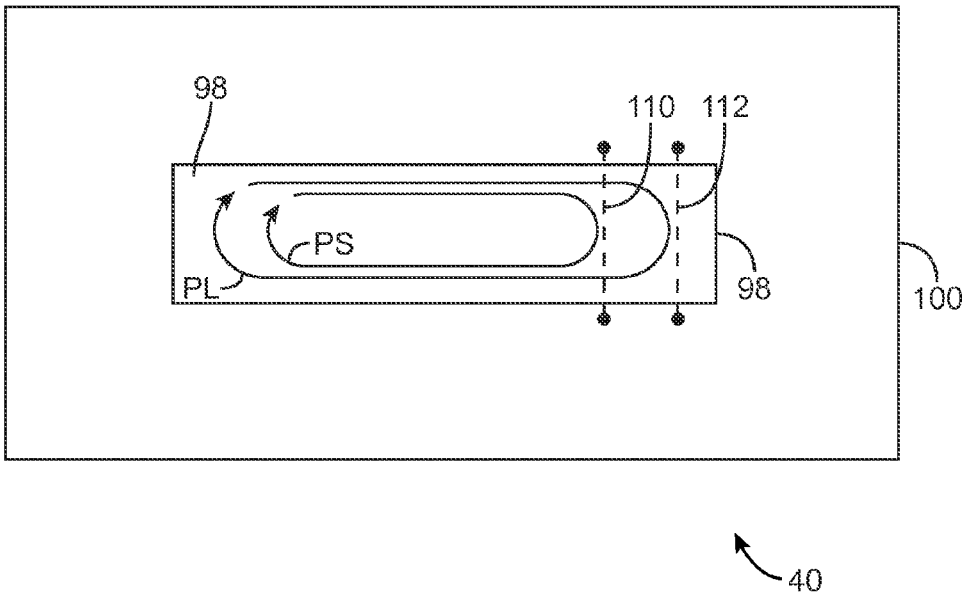
FIG. 6 is a top view of a slot antenna showing how the position of conductive antenna structures in the slot antenna can be varied to adjust slot size and thereby adjust antenna performance to compensate for manufacturing variations in accordance with an embodiment.

FIG. 6 illustrates how a slot antenna may be affected by the configuration of conductive elements that overlap the slot. As shown in FIG. 6, slot antenna 40 of FIG. 6 has a slot opening 98 in conductive structure 100. Two illustrative configurations are illustrated in FIG. 6. In the first configuration, conductive element 110 bridges the end of slot 98. In the second configuration, conductive element 112 bridges the end of slot 98.

The length of the perimeter of opening 98 affects the position of the resonance peaks of antenna 40 (e.g., there is typically a resonance peak when radio-frequency signals have a wavelength equal to the length of the perimeter). When element 112 is present in slot 98, the size of the slot is somewhat truncated and exhibits long perimeter PL. When element 110 is present across slot 98, the size of the slot is further truncated and exhibits short perimeter PS. Because PS is shorter than PL, antenna 40 will tend to exhibit a resonance with a higher frequency when structure 110 is present than when structure 112 is present.

Figure 7:
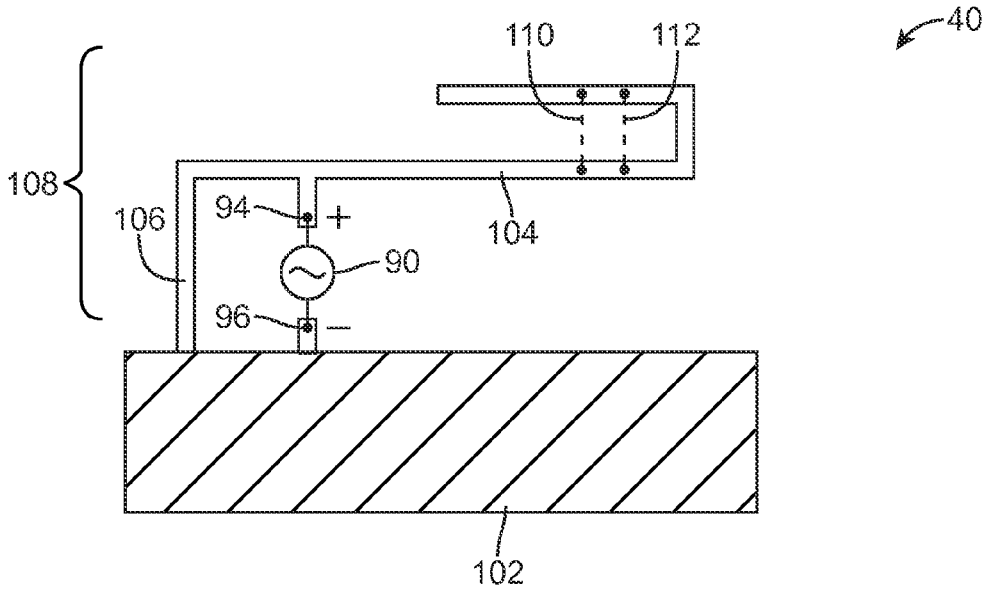
FIG. 7 is a diagram of an inverted-F antenna showing how the position of conductive antenna structures in the inverted-F antenna can be varied to adjust the size of an antenna resonating element structure and thereby adjust antenna performance to compensate for manufacturing variations in accordance with an embodiment.

The size and shape of the conductive structures in other types of antennas such as inverted-F antenna 30 of FIG. 7 affect the performance of those antennas. As shown in FIG. 7, antenna resonating element arm 104 in antenna resonating element 108 of antenna 40 may be have a conductive structure that can be placed in the position of conductive structure 110 or the position of conductive structure 112. The position of this conductive structure alters the effective length of antenna resonating element arm 104 and thereby alters the position of the antenna's resonant peaks.

As the examples of FIGS. 3-7 demonstrate, alterations to the positions of antenna feed terminals and the conductive materials that form an antenna change the frequency response of the antenna. Due to manufacturing variations, antenna feed positions and conductive antenna material shapes and sizes may be inadvertently altered, leading to variations in an antenna's frequency response relative to a desired nominal frequency response. These unavoidable manufacturing variations may arise due to the limits of manufacturing tolerances (e.g., the limited ability to machine metal parts within certain tolerances, the limited ability to manufacture printed circuit board traces with desired conductivities and line widths, trace thickness, etc.). To compensate for undesired manufacturing variations such as these, device 10 may include adjustable antenna structures.

The adjustable antenna structures may be implemented using any suitable structures that may be configured differently for different devices. With one suitable arrangement, which is sometimes described herein as an example, adjustable antenna structures may be implemented using a repositionable structure with conductive components such as metal traces that can be placed in different positions within an antenna. The repositionable structure may be formed from a dielectric support structure with conductive patterned portions. For example, the repositionable structure may be formed from a material such as plastic on which multiple metal traces have been formed. By positioning the repositionable structure appropriately within an antenna, the performance of the antenna can be tuned to compensate for manufacturing variations.

The repositionable structures may have multiple signal paths. The dielectric support structure may be moved into a position that switches (couples) a selected one of the signal paths into use to convey antenna signals for an antenna feed or other portion of antenna 40. The dielectric support structures may be mounted within the antenna using adhesive, engagement features such as snaps or clips, fasteners such as screws, or other mounting arrangements. Configurations based on a screw are sometimes described herein as an example.

In a typical manufacturing process, different individual electronic devices or different batches of electronic devices (e.g., batches of antenna structures 40 and/or device 10 formed form parts from different vendors or parts made from different manufacturing processes) can be individually characterized. One the antenna performance for an individual antenna 40 and/or device 10 or for a given batch of antennas 40 and/or devices 10 has been ascertained, any needed compensating adjustments can be made by and installing adjustable antenna structures at an appropriate location within the antenna portion of each device.

As an example, a first repositionable antenna structure may be installed in a position within an antenna in a first device that ensures that the performance of the first device (or first batch of devices) is performing as expected, whereas a second repositionable antenna structure may be installed in a position within an antenna in a second device that ensures that the performance of a second device (or second batch of devices) is performing as expected. With this type of arrangement, antenna performances for the first and second devices (or batches of devices) can be adjusted during manufacturing by virtue of appropriate positioning of the repositionable antenna structures when installing the repositionable antenna structures within the antennas of the devices, so that identical or nearly identical performance between the first and second devices or batches of devices is obtained.

Figure 8:
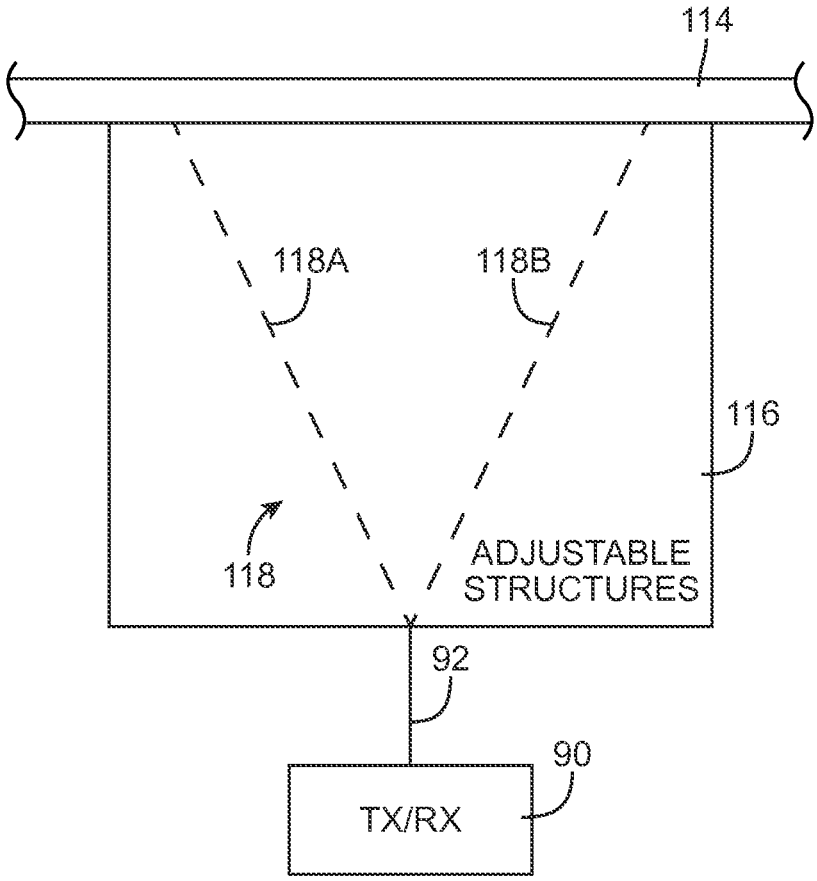
FIG. 8 is a diagram of antenna structures in an electronic device showing how an adjustable antenna structure such as a repositionable antenna structure may be used to adjust an antenna to compensate for manufacturing variations in accordance with an embodiment.

FIG. 8 shows how antenna 40 may include conductive structures such as conductive antenna structures 114 and adjustable antenna structures such as repositionable antenna structures 116. Conductive structures 114 may be antenna resonating element structures, antenna ground structures, etc. With one suitable arrangement, conductive structures 114 may be conductive housing structures (e.g., conductive portions of housing 12 such as a peripheral conductive housing member that runs around the rectangular periphery of electronic device 10) and/or may be traces on printed circuit boards within electronic device 10. Adjustable antenna structures 116 may be interposed between transmission line 92 (e.g., a positive trace and/or a ground trace in transmission line 92) and conductive structures 114. Transceiver circuitry 90 may be coupled to transmission line 92.

As shown in FIG. 8, adjustable structures 116 may include signal paths such as signal path 118. Signal path 118 may include positive and ground structures (e.g., to form transmission structures) or may contain only a single signal line (e.g., to couple part of a transmission line to an antenna structure, to couple respective antenna structures together such as two parts of an antenna resonating element, to connect two parts of a ground plane, etc.). Signal path 118 may be adjusted during manufacturing operations. For example, adjustable structures 116 may be positioned within the antenna structures of device 10 so that a conductive line or other path takes the route illustrated by path 118A of FIG. 8 or may be positioned within the antenna structures of device 10 so that a conductive line or other path takes the route illustrated by path 118B of FIG. 8.

One or more metal traces on a movable dielectric support structure may be used in forming paths 118A and 118B. For example, a single metal trace may be positioned in to form path 118A or path 118B, as needed to compensate for manufacturing variations. If desired, multiple parallel, electrically isolated metal traces on a plastic carrier may be used. This type of multi-trace arrangement for adjustable structures 116 is sometimes described herein as an example. Adjustable structures with three or more potential configurations (formed using a single metal trace or multiple metal traces) may also be used, if desired.

Adjustable structures 116 may be implemented using a plastic carrier or other structure with multiple metal traces. By positioning the plastic carrier appropriately relative to other structures in device 10, the metal traces form path 118A or path 118B, as desired. For example, some electronic devices may receive adjustable structures 116 that have been positioned so that path 118 follows a trace forming route 118A, whereas other electronic devices may receive adjustable structures 116 that have been positioned so that path 118 follows a trace forming route 118B. By providing different electronic devices (each of which includes an antenna of the same nominal design) with appropriately positioned antenna structures 116, performance variations can be compensated and performance across devices can be equalized.

Figure 9:
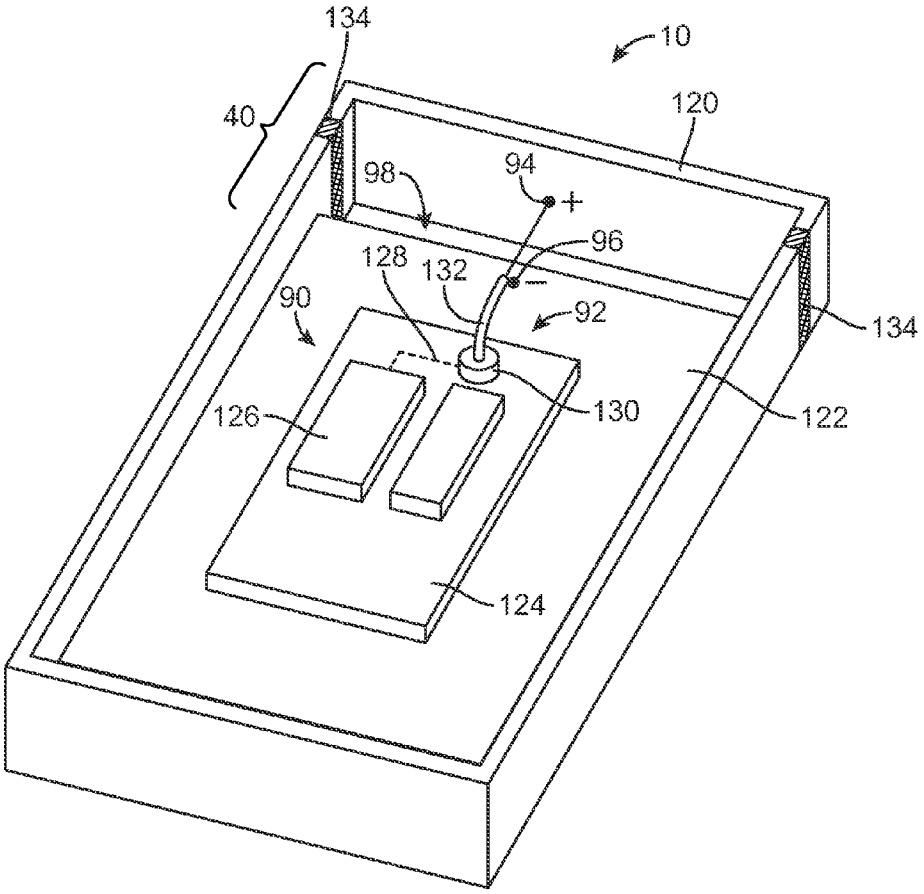
FIG. 9 is a perspective interior view of an illustrative electronic device of the type that may be provided with repositionable antenna structures to adjust antenna performance and thereby compensate for manufacturing variations in accordance with an embodiment.

An illustrative arrangement that may be used for electronic device 10 of FIG. 1 is shown in FIG. 9. In the configuration of FIG. 9, display 14 has been removed so that the interior components of device 10 are visible. Antenna 40 may be formed from conductive structures such as conductive housing member 120 and conductive housing member 122. Conductive housing member 122 may be a metal plate or other conductive support structure and may form an exterior housing wall or interior support frame for device 10. Conductive housing member 120 may be a peripheral conductive housing member that surrounds the periphery of housing 12. For example, conductive housing member 120 may be a bezel or trim structure that surrounds display 14 (FIG. 1) or may be a flat or curved metal sidewall structure (e.g., a band-shaped structure or other peripheral conductive member) that surrounds the rectangular outline (periphery) of device 10 when viewed from the front. Conductive member 120 may, for example, be formed from stainless steel or other metals.

An opening such as opening 98 may be used in forming antenna 40 (e.g., a slot antenna, a loop antenna, part of a hybrid antenna such as a hybrid planar-inverted-F antenna and slot antenna, an inverted-F antenna, etc.). Opening 98 may be an air-filled slot opening or a slot-shaped opening filled with air and/or solid dielectric material such as plastic, printed circuit board substrates, glass, and ceramic. Opening 98 may be formed between portions of conductive peripheral member 120 and opposing portions of conductive member 122. One or more dielectric-filled gaps such as gaps 134 (e.g., gaps filed with plastic, glass, ceramic, air, other dielectrics, or a combination of such dielectrics) can be interposed within peripheral conductive structure 120 (e.g., in the vicinity of opening 98). Gaps such as gaps 134 may be used to create loop antenna structures, a single arm or dual arm inverted-F antenna, and other suitable structures for antenna 40. Antenna 40 may also be based on a closed-slot architecture (i.e., a slot that is completely surrounded by conductor) or an open-slot architecture (i.e., a slot that has an open end) or other suitable antenna designs.

Transceiver 90 may be implemented using one or more integrated circuits such as integrated circuit 126. Integrated circuit 126 and other electrical components may be mounted on a substrate such as substrate 124. Substrate 124 may be, for example, a flexible printed circuit formed from a flexible layer polymer such as a sheet of polyimide or a rigid printed circuit board substrate (as examples). Transmission line 92 may be coupled between transceiver 90 and antenna 40. Transmission line 92 may include printed circuit board traces 128, radio-frequency connectors such as radio-frequency connector 130, coaxial cables such as cable 132, and other conductive structures. If desired, impedance matching circuitry, filter circuitry, switching circuitry, and other circuitry may be interposed within paths such as transmission line 92. The configuration of FIG. 9 is merely illustrative.

Adjustable antenna structures (e.g., structures 116 of FIG. 8) may be incorporated into device 10 to adjust the antenna feed of antenna 40 and/or other conductive antenna structures associated with antenna 40, thereby ensuring that antenna 40 performs as desired. The adjustable antenna structures may, for example, be adjusted by positioning the structures at an appropriate location within device 10 to form a desired signal path, as described in connection with FIG. 8. The structures may be mounted using fasteners, adhesive, or other fastening structures that allow the structures to be move relative to device 10 and antenna 40 and, following movement to a desired location, that hold the structures in place. Adjustable antenna structures 116 are sometimes referred to herein as repositionable antenna structures. Other types of adjustable antenna structures may be used in device 10 if desired.

Repositionable antenna structures 116 may include one or more parts. For example, repositionable antenna structures 116 may include a movable dielectric member on which metal traces are formed, a flexible structure such as a spring contact member to facilitate contact between the metal traces and a peripheral conductive housing member or other conductive structure in antenna 40, and fastening structures for mounting the movable dielectric member within device 10.

Figure 10:
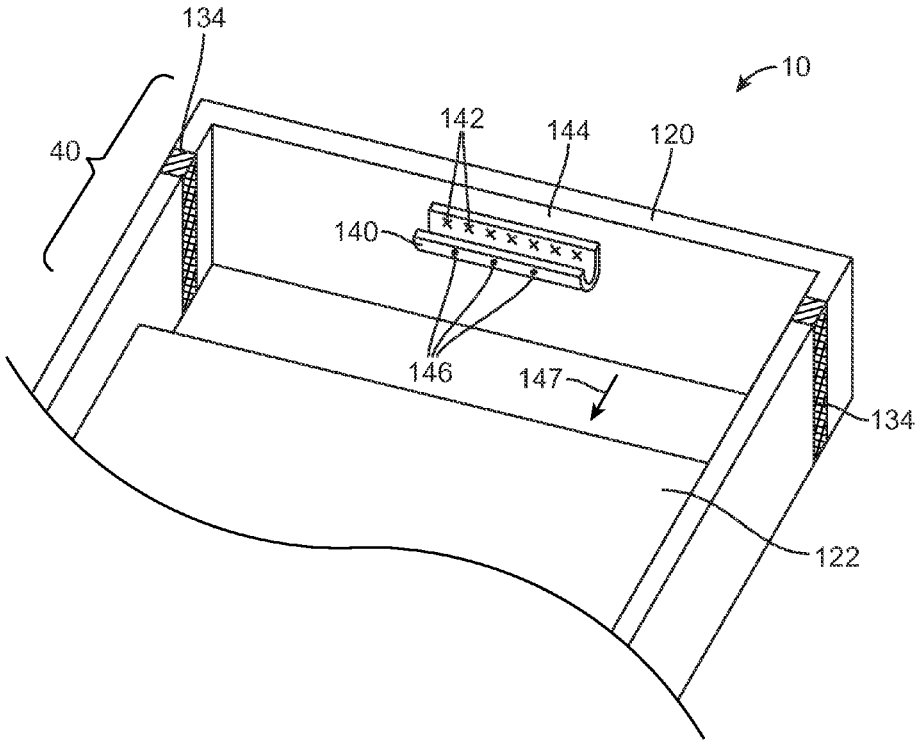
FIG. 10 is a perspective interior view of the illustrative electronic device of FIG. 9 showing how a spring member may be welded to a peripheral conductive housing member that forms part of an antenna in accordance with an embodiment.

FIG. 10 is an interior perspective view of device 10 showing an illustrative flexible structure that may be used in forming repositionable antenna structures 116. As shown in FIG. 10, a flexible structure such as flexible metal spring 140 may be attached to peripheral conductive housing member 120. Metal spring 140 may be formed from a bent piece of sheet metal. Spring 140 may be attached to inner surface 144 of peripheral conductive housing member 120 in antenna 40 using attachment structures 142. Attachment structures 142 may be welds, solder joints, conductive adhesive, fasteners such as screws, or other suitable attachment structures.

Movable structures such as a movable dielectric member with metal traces may be positioned within device 10 relative to spring 140 to adjust antenna 40. For example, a path such as path 118A or path 118B in the example of FIG. 8 may be coupled to spring 140 at a contact location such as one of contact locations 146. The flexibility of spring 140 may allow spring 140 to produce a biasing force in direction 147 when compressed between the movable dielectric member and peripheral conductive housing member 120. The biasing force may facilitate formation of a good ohmic contact between spring 140 (and therefore peripheral conductive housing member 120) and the metal traces on the movable dielectric member.

Figure 11:
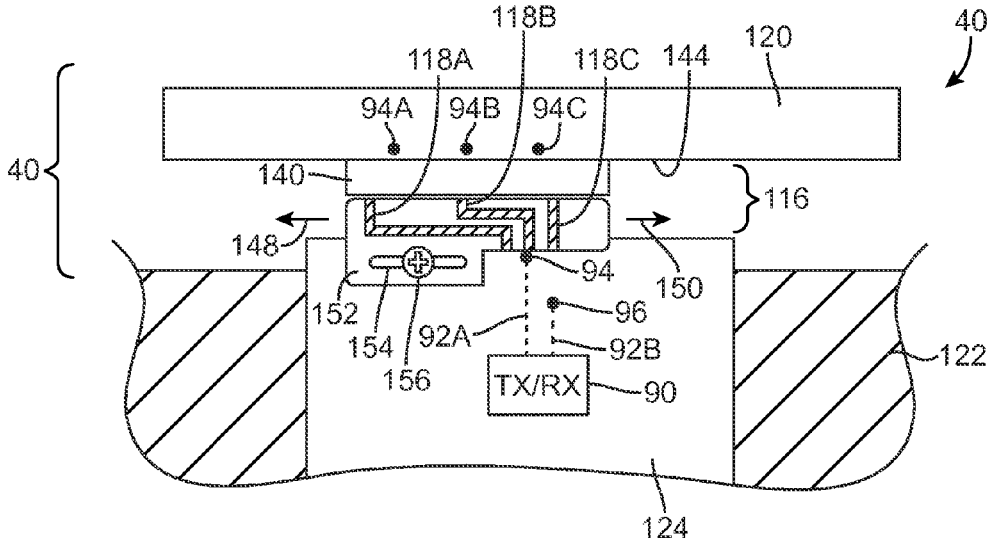
FIG. 11 is a top view of a portion of an electronic device having an adjustable antenna formed using a repositionable antenna structure with metal traces in accordance with an embodiment.

FIG. 11 is a top view of repositionable antenna structures 116 showing how structures 116 may include metal spring 140, a movable dielectric member such as movable plastic member 152 with metal traces such as metal traces 118A, 118B, and 118C, and a screw such as screw 156 or other attachment mechanism for mounting movable plastic member 152 at a desired position within device 10. Movable plastic member 152 may have one or more openings such as slot 154 to accommodate one or more fasteners such as one or more screws 156. Openings such as slot 154 may accommodate movement of plastic member 152 relative to device 10. For example, slot 154 may allow plastic member 152 to be moved in direction 148 or direction 150 so that a selected one of paths 118A, 118B, and 118C may be switched into use in antenna 40. When plastic member 152 has been positioned in a desired location relative to the housing of device 10, screw 156 may be tightened to mount plastic member 152 in a fixed location. Assembly of device 10 may then be completed, so that device 10 can be used by a user.

In the illustrative configuration of FIG. 11, adjustable structures 116 form an adjustable portion of antenna structures 40 (e.g., inverted-F antenna structures or loop antenna structures). The feed of antenna 40 can be adjusted between three possible positions: feed point 94A, feed point 94B, and feed point 94C. Transmission line structures such as transmission line paths 92A and 92B may be formed on a substrate such as printed circuit 124 and may be coupled to transceiver circuitry 90. Transmission line ground path 92B may be coupled to antenna ground feed terminal 96B. Transmission line positive signal path 92A may be coupled to peripheral conductive housing member 120 in antenna 40 at feed point 94A, 94B, or 94C using repositionable antenna structure 116. When positioned in a first location, path 118A will couple positive antenna feed 94 to positive antenna feed point 94A on member 120. When positioned in a second location, path 118B will couple feed 94 to antenna feed point 94B. Feed point 94C can be selected by positioning member 152 so that path 118C routes signals been terminal 94 of path 92A and point 94C on member 120.

Figure 12:
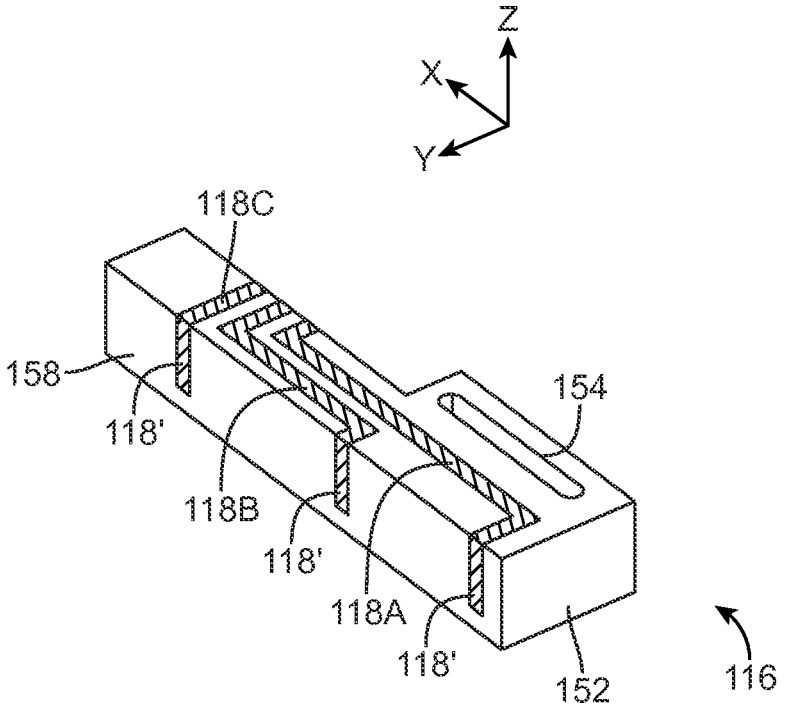
FIG. 12 is a front perspective view of an illustrative repositionable antenna structure having metal traces for forming different antenna signal paths within an antenna to adjust antenna performance and thereby compensate for manufacturing variations in accordance with an embodiment.
Figure 13:
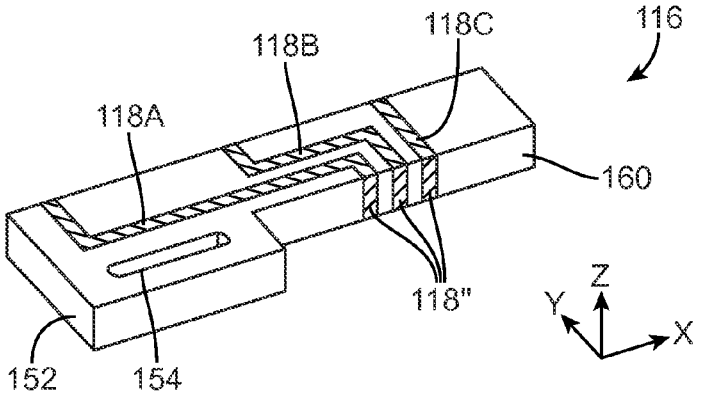
FIG. 13 is a rear perspective view of the illustrative repositionable antenna of FIG. 12 in accordance with an embodiment.

A perspective view of movable plastic member 152 is shown in FIG. 12. In the illustrative configuration of FIG. 12, plastic member 152 has been provided with three separate (electrically isolated) metal traces 118A, 118B, and 118C, each capable of forming a different signal path for coupling terminal 94 of FIG. 11 to peripheral conductive housing member 120. Metal trace portions 118' on face 158 of plastic member 152 may bear against spring 140. As shown in the perspective view of FIG. 13, traces 118A, 118B, and 118C may have portions 118" that run vertically down face 160 (i.e., a face on the opposing side of plastic member 152 from face 158 of FIG. 12). Portions 118" may, if desired, extend without interruption to lower surface 162 of plastic member 152 to form respective trace portions 118''', as shown in FIG. 14.

Figure 15:
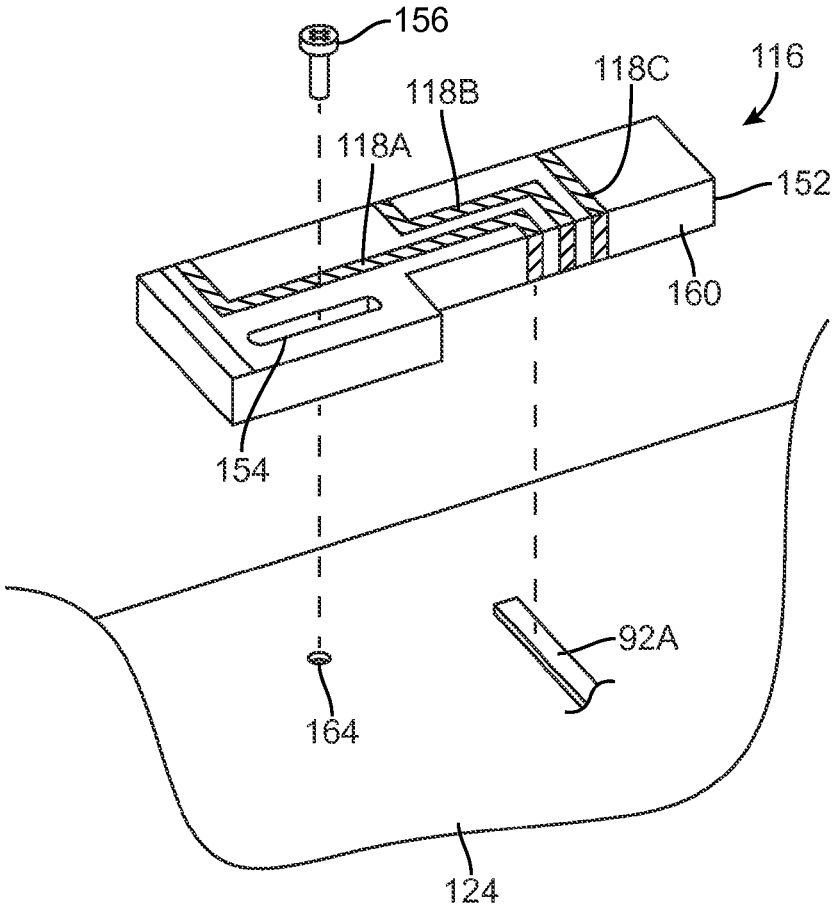
FIG. 15 is an exploded perspective view of a repositionable antenna structure and an associated antenna feed trace to which a selected metal trace on the repositionable antenna structure can be coupled to adjust antenna performance in accordance with an embodiment.

FIG. 15 is an exploded perspective view of adjustable structures 116 showing how screw 156 may be pass through an opening in printed circuit 124 such as opening 164. The shaft of screw 156 may pass through slot 154, so that screw 156 can be positioned at different locations in slot 154 when the position of plastic member 152 relative to device 10 is being adjusted. Once plastic member 152 has been placed in a desired location, screw 156 may be tightened to secure member 152 to printed circuit 124.

Figure 14:
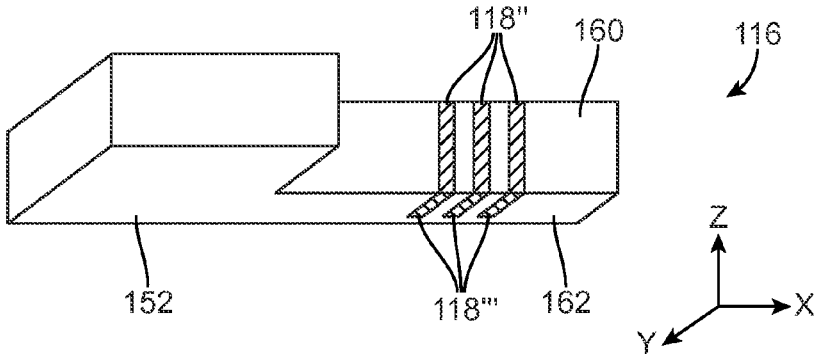
FIG. 14 is bottom perspective view of the illustrative repositionable antenna structure of FIGS. 12 and 13 in accordance with an embodiment.

When plastic member 152 is secured to printed circuit 124 using screw 156, a selected one of trace portions 118''' of FIG. 14 is connected to a metal trace on printed circuit 124 such as trace 92A of FIG. 15 (as an example).

Figure 16:
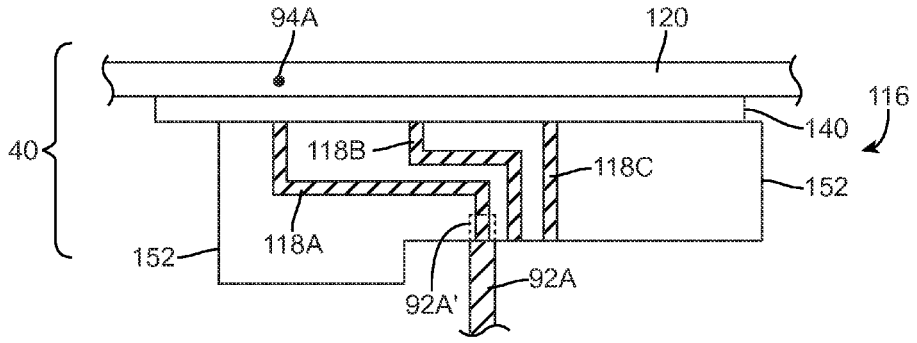
FIG. 16 is a top view of a portion of an antenna in which a repositionable antenna structure has been positioned to couple a trace on the left-hand side of the repositionable antenna structure to an antenna feed trace on a printed circuit board in accordance with an embodiment.
Figure 17:
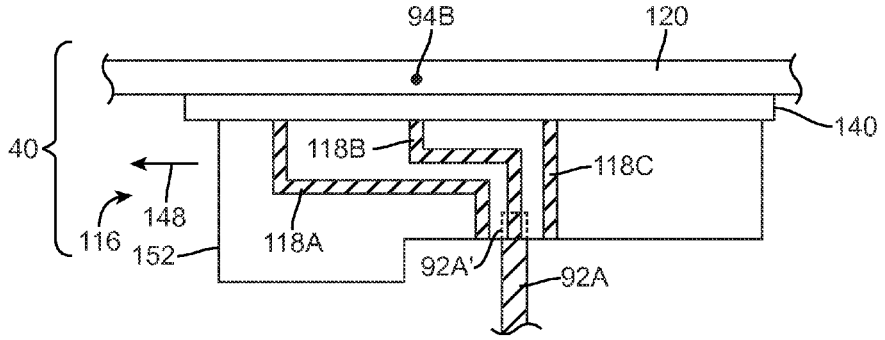
FIG. 17 is a top view of a portion of an antenna in which a repositionable antenna structure has been positioned to couple a trace in the middle of the repositionable antenna structure to an antenna feed trace on a printed circuit board in accordance with an embodiment.
Figure 18:
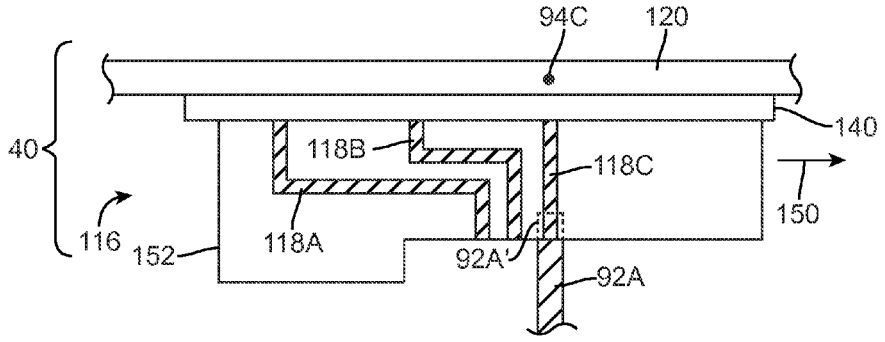
FIG. 18 is a top view of a portion of an antenna in which a repositionable antenna structure has been positioned to couple a trace on the right-hand side of the repositionable antenna structure to an antenna feed trace on a printed circuit board in accordance with an embodiment.

FIGS. 16, 17, and 18 illustrate how the feed location for antenna 40 can be adjusted by adjustment of the position of plastic member 152 relative to trace 92A. Trace 92A may be a positive transmission line trace that is coupled to a positive antenna feed terminal and may therefore sometimes be referred to as a positive antenna feed or positive antenna feed trace.

In the configuration of FIG. 16, plastic member 152 has been positioned so that trace portion 118''' of trace 118A on underside surface 162 of member 152 bears against overlapping portion 92A' of trace 92A. In the configuration of FIG. 17, plastic member 52 has been moved in direction 148 relative to the position of plastic member 152 in FIG. 16. As a result, metal trace 118B has been coupled to trace 92A. FIG. 18 shows how plastic member 152 may be moved in direction 150 relative to the positions of FIGS. 16 and 17 so that trace 118C is coupled to trace 92A. In the FIG. 16 configuration, the antenna feed for antenna 40 is associated with feed 94A on conductive peripheral housing member 120. In the FIG. 17 configuration, the antenna feed is formed at a different location (i.e., the location of antenna feed point 94B of FIG. 17). FIG. 18 shows how movement of member 152 to align trace 118C with trace 92A configures adjustable structures 116 so that antenna 40 is fed at positive antenna feed 94C. Selection of a desired position for plastic member 152 therefore adjusts the position of the antenna feed for antenna 40 by coupling an appropriate one of the metal traces on plastic member 152 into use.

Figure 19:
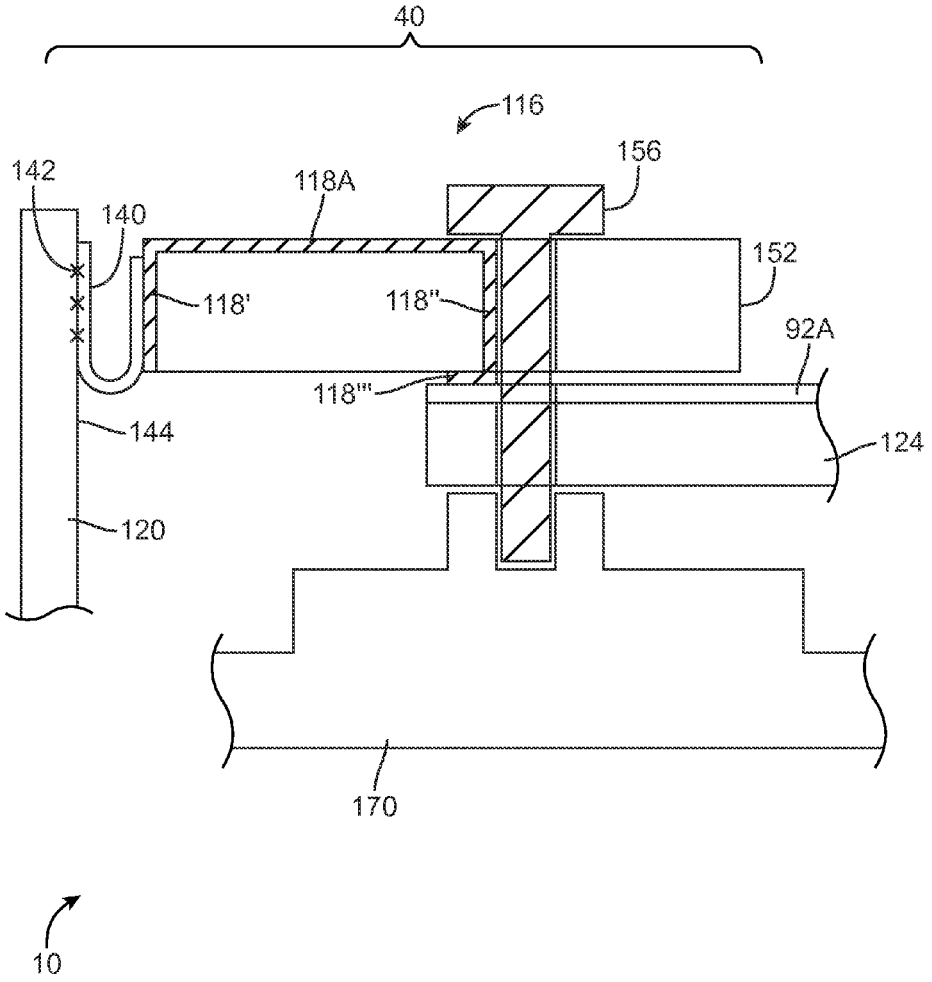
FIG. 19 is a cross-sectional side view of a portion of an antenna showing how a repositionable antenna structure may be used to couple a printed circuit board trace such as an antenna feed trace to a conductive antenna structure to adjust the antenna in accordance with an embodiment.

FIG. 19 is a cross-sectional side view of adjustable structures 116 showing how screw 156 may, if desired, form a conductive antenna signal path. Metal traces on plastic carrier 152 such as illustrative trace 118A may be coupled to trace 92A on printed circuit 124 using portions 118" and 118'''. If desired, screw 156 may contact portions of trace 118A and portions of device structures 170. Screw 156 may be formed form a conductive material such as metal and may therefore form part of an antenna signal path (e.g., a path between trace 118A and structure 170 in the FIG. 19 example). Structures 170 may be housing 12, conductive housing structure 122, part of printed circuit 124, or other suitable conductive antenna structures (e.g., part of an antenna ground). Screws such as screw 156 may form the only path between trace 92A and trace 118A or may form a path that runs parallel to other paths such as path 118". Springs (e.g., metal spring fingers), conductive adhesive, or other structures may also be used in forming a desired signal path between a trace on plastic member 152 and trace 92A. The configuration of FIG. 19 is merely illustrative.

Figure 20:
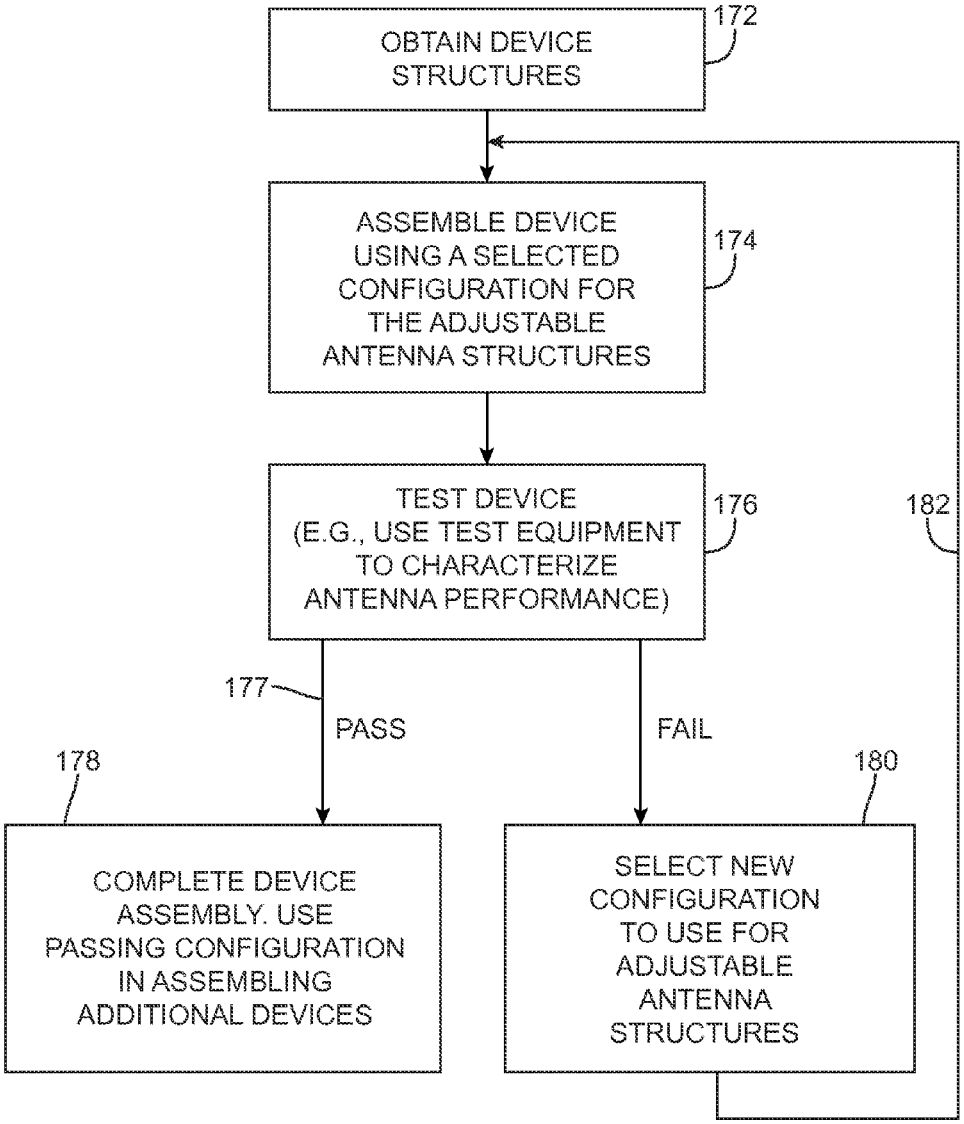
FIG. 20 is a flow chart of illustrative steps involved in characterizing antenna performance in an electronic device formed from a set of components and compensating for manufacturing variations by adjusting the position of adjustable antenna structures within an electronic device housing during device fabrication in accordance with an embodiment.

FIG. 20 is a flow chart of illustrative steps involved in manufacturing devices that include adjustable antenna structures 116.

At step 172, parts for a particular design of device 10 may be manufactured and collected for assembly. Parts may be manufactured by numerous organizations, each of which may use different manufacturing processes. As a result, there may be manufacturing variations in the parts that can lead to undesirable variations in antenna performance if not corrected.

At step 174, a manufacturer of device 10 may assemble the collected parts to form at least part of device 10. The assembled portion of device 10 may exhibit manufacturing variations. A typical manufacturing line may produce thousands or millions of nominally identical units of device 10. Production may take place in numerous batches. Batches may involve thousands of units or more that are assembled from comparable parts (i.e., parts made using identical or similar manufacturing processes). Batch-to-batch variability in antenna performance is therefore typically greater than antenna performance variability within a given batch.

After assembling device 10 (or multiple devices 10) at step 174, device 10 may be characterized at step 176. For example, the frequency response of the antenna can be measured to determine whether there are frequency response curve shifts and other variations between the device and desired performance characteristics.

When assembling device 10 at step 174, adjustable antenna structures 116 may be placed in a nominal configuration or in a configuration that is believed to compensate for expected performance variations (e.g., when assembling a device that is part of a batch that has already been characterized as having a particular type of performance variation). Member 152 may be placed in a selected position to switch a nominal path or other desired path into use (e.g., a selected one of traces 118A, 118B, and 118C in the example of FIG. 11) and thereby adjust the position of the antenna feed or other signal path in antenna 40 so that antenna 40 performs as desired.

As indicated by line 177, adjustable antenna structures 116 and other device structures may be assembled at step 174 in a way that produces a device that passes testing at step 176. If testing during step 176 reveals that additional modifications are not needed, device assembly may be completed at step 178 and device 10 may be used by a user.

If testing during step 176 reveals that adjustments to adjustable antenna structures 116 are needed, a new feed location for antenna 40 may be identified at step 180 (e.g., using antenna modeling software or experimental results). As indicated by line 182, processing may then return to step 174, where screw 156 may be loosened and the position of member 152 adjusted to place member 152 into the position identified at step 180.

When manufacturing devices 10 in batches, it may be possible to assemble devices within each batch using a given one of the possible positions for antenna structures 116 without excessive repositioning operations. As an example, once a suitable location for structures 116 within a given device 10 has been identified at step 180, all additional antennas 40 and devices 10 in the same batch may be assembled using the indentified location (step 174). Test at step 176 may be omitted once the appropriate location for structures 116 has been identified for the batch or testing at step 176 may be performed on all devices in the batch to verify antenna operation and to perform any individual adjustments to structures 116 that are desired to optimize antenna performance.

In a typical scenario, once the proper position that is needed for structures 116 within a given batch has been identified (i.e., once the proper location for plastic member 152 for compensating for manufacturing variations have been selected from a plurality of different possible locations), all devices 10 within that batch may be manufactured using the same position for antenna structures 116. If manufacturing tolerances create a scenario in which device-to-device adjustment of structures 116 is needed, each device 10 can be tested and appropriate adjustments to the position of member 152 made.

The foregoing is merely illustrative of the principles of this invention and various modifications can be made by those skilled in the art without departing from the scope and spirit of the invention. The foregoing embodiments may be implemented individually or in any combination.

What is claimed is:

1. An antenna, comprising:

a printed circuit board trace;

conductive antenna structures; and adjustable antenna structures that include a plurality of conductive paths, wherein the adjustable antenna structures are movable with respect to the printed circuit board trace to couple a selected one of the conductive paths between the conductive antenna structures and the printed circuit board trace to compensate for manufacturing variations in the antenna.

2. The antenna defined in claim 1 wherein the adjustable antenna structures include a plastic member and wherein the plurality of conductive paths include a plurality of metal traces on the plastic member.

3. The antenna defined in claim 2 wherein the plastic member includes a slot, the antenna further comprising:

a printed circuit board on which the printed circuit board trace is formed; and a fastener that extends through the slot and the printed circuit board to attach the adjustable antenna structures to the printed circuit board.

4. The antenna defined in claim 1 wherein the conductive antenna structures comprises a conductive electronic device housing structure.

5. The antenna defined in claim 1 wherein the printed circuit board trace comprises a transmission line trace.

6. The antenna defined in claim 1 further comprising a spring coupled between the selected one of the plurality of conductive paths and the conductive antenna structures.

7. The antenna defined in claim 6 wherein the spring is welded to the conductive antenna structures.

8. A method for fabricating a wireless electronic device having an antenna that includes a conductive antenna resonating element structure having a plurality of feed points and movable antenna structures having a plurality of metal traces each associated with a respective possible antenna signal path, the method comprising:

moving the movable antenna structures relative to the plurality of feed points within the electronic device to a location that couples a selected one of the metal traces to a selected one of the feed points to form a signal path that is coupled to the conductive antenna resonating element structure; and securing the movable antenna structures to the electronic device so that antenna signals are conveyed to the selected one of the feed points by the selected one of the metal traces.

9. The method defined in claim 8 wherein the antenna has feed terminals and wherein moving the movable antenna structures comprises coupling the selected one of the metal traces into use to adjust where at least one of the feed terminals is located.

10. The method defined in claim 9 wherein the conductive antenna resonating element structure comprises a conductive electronic device housing structure and wherein moving the movable antenna structures comprises adjusting a positive antenna feed location on the conductive electronic device housing structure.

11. The method defined in claim 8 wherein securing the movable antenna structures comprises securing the movable antenna structures such that the selected one of the metal traces is in alignment with the selected one of the feed points and the metal traces other than the selected one of the metal traces are out of alignment with the feed points other than the selected one of the feed points.

12. The method defined in claim 8, wherein the movable antenna structures include a movable member on which the plurality of metal traces are formed, a slot that extends through the movable member, and a fastener that extends through the slot, wherein moving the movable antenna structures comprises sliding the movable member to change a position of the fastener within the slot.

13. An electronic device, comprising:

an antenna having a conductive structure;

a transceiver having a transmission line conductor; and adjustable antenna structures, wherein the adjustable antenna structures include multiple conductive paths and wherein the adjustable antenna structures are movable relative to the transmission line conductor to couple a selected one of the multiple conductive paths to the transmission line conductor to convey signals between the transmission line conductor and the conductive structure to compensate for manufacturing variations that affect antenna performance in the antenna.

14. The electronic device defined in claim 13 wherein the transmission line conductor comprises a trace on a printed circuit and wherein the adjustable antenna structures comprise a movable dielectric member on which the multiple conductive paths are formed.

15. The electronic device defined in claim 14 wherein the multiple conductive paths comprise metal traces.

16. The electronic device defined in claim 13 wherein the adjustable antenna structures include a movable dielectric member having an opening and a fastener that extends through the opening to mount the movable dielectric member within the electronic device.

17. The electronic device defined in claim 13 wherein the adjustable antenna structures include a spring.

18. The electronic device defined in claim 17 wherein the conductive structures comprise a conductive peripheral housing member that forms at least some sidewall structures for the electronic device and wherein the spring is welded to the conductive peripheral housing member.

19. The electronic device defined in claim 18 wherein the adjustable antenna structures include a movable plastic member and wherein the multiple conductive paths comprise metal traces on the plastic member that bear against the spring.

20. The electronic device defined in claim 19 wherein the transmission line conductor comprises a transmission line trace on a printed circuit and wherein a portion of the selected one of the multiple conductive paths bears against the transmission line trace.

21. The electronic device defined in claim 20 wherein the antenna has antenna feed terminals and wherein the metal traces on the plastic member are configured to couple a selected one of the antenna feed terminals into use.

22. The electronic device defined in claim 13 further comprising a housing, wherein the adjustable antenna structures comprise a dielectric member having a position that is adjusted by mounting the dielectric member at a desired location within the housing.

23. The electronic device defined in claim 13 wherein the adjustable antenna structure comprises a plastic member with an opening and at least one structure that passes through the opening that carries antenna signals.

* * * * *